US007452262B2

(12) United States Patent
Friel, Sr.

(10) Patent No.: US 7,452,262 B2
(45) Date of Patent: Nov. 18, 2008

(54) KNIFE SHARPENERS WITH IMPROVED KNIFE GUIDES

(75) Inventor: Daniel D. Friel, Sr., Greenville, DE (US)

(73) Assignee: Edgecraft Corporation, Avondale, PA (US)

( * ) Notice: Subject to any disclaimer, the term of this patent is extended or adjusted under 35 U.S.C. 154(b) by 0 days.

(21) Appl. No.: 12/031,143

(22) Filed: Feb. 14, 2008

(65) Prior Publication Data

US 2008/0127780 A1 Jun. 5, 2008

Related U.S. Application Data

(62) Division of application No. 11/676,597, filed on Feb. 20, 2007.

(60) Provisional application No. 60/776,135, filed on Feb. 23, 2006.

(51) Int. Cl.
*B24B 49/00* (2006.01)

(52) U.S. Cl. ..... 451/6; 451/9; 451/10; 451/11; 451/278; 451/293; 451/349; 451/549

(58) Field of Classification Search ..... 451/6, 451/8, 9, 10, 11, 45, 193, 278, 293, 321, 451/349, 549, 555
See application file for complete search history.

(56) References Cited

U.S. PATENT DOCUMENTS 4,627,194 A 12/1986 Friel
4,716,689 A 1/1988 Friel
4,807,399 A 2/1989 Friel
4,897,965 A 2/1990 Friel
5,005,319 A 4/1991 Friel
5,148,634 A 9/1992 Bigliano
5,245,791 A 9/1993 Bigliano
5,390,431 A 2/1995 Friel
5,404,679 A 4/1995 Friel
5,449,315 A 9/1995 Friel
5,582,535 A 12/1996 Friel
5,611,726 A 3/1997 Friel
5,868,611 A 2/1999 Friel
6,012,971 A 1/2000 Friel
6,113,476 A 9/2000 Friel
6,267,652 B1 7/2001 Friel
6,726,551 B2 4/2004 Friel
6,863,600 B2 3/2005 Friel
6,875,093 B2 4/2005 Friel
6,881,137 B2 4/2005 Friel
6,997,795 B2 2/2006 Friel
7,081,040 B2 * 7/2006 Varney et al. ..... 451/5
7,235,004 B2 * 6/2007 Friel et al. ..... 451/198
7,235,044 B2 6/2007 Friel
7,287,445 B2 10/2007 Friel
2004/0116055 A1 * 6/2004 Friel, Sr. ..... 451/293
2004/0198198 A1 * 10/2004 Friel et al. ..... 451/198
2006/0130932 A1 * 6/2006 Chen et al. ..... 144/28.4
2006/0192939 A1 * 8/2006 Lebeau ..... 356/69

* cited by examiner

*Primary Examiner*—Eileen P. Morgan
(74) *Attorney, Agent, or Firm*—Connolly Bove Lodge & Hutz, LLP

(57) ABSTRACT

Various forms of knife guides are provided for knife sharpeners to minimize damage to the knife blade. One of the forms of knife guides comprises non-contact optical arrangements which includes a light source, at least one light detector and an indicator that monitors and displays the intensity of light reflected from the blade surface.

6 Claims, 4 Drawing Sheets

KNIFE SHARPENERS WITH IMPROVED KNIFE GUIDES

CROSS REFERENCE TO RELATED APPLICATION

This application is a division of application Ser. No. 11/676,597 filed Feb. 20, 2007 which is based upon provisional application Ser. No. 60/776,135 filed Feb. 23, 2006, all of the details of both applications are incorporated herein by reference thereto.

BACKGROUND OF INVENTION

Modern blade sharpeners depend upon precise control of the sharpening angles in order to obtain the sharpest knives. Generally there are precision guides which insure that the blade is held at the same angle relative to the plane of the sharpening abrasive or to the plane of the sharpening steel on each and every sharpening stroke. In order to develop the sharpest edges it is important that the blade and the surface of the abrasive material be held in a consistent angular position on each sharpening stroke across the abrasive.

In order to maintain a consistent angle of the facets (that meet to create the edge) as they contact a sharpening or steeling element, it has been shown important to have angle guides that physically relate to some feature of the knife blade. It is convenient and practical to reference from the face of the blade to set the angle of the blade edge facets relative to the surface plane of the sharpening or steeling element at the point of contact.

Consequently it is common in sharpening to lay the face of the blade against a planar single guiding surface and to slide the blade with its face in good physical contact with that surface while the edge facet is being modified by the abrasive or steeling element.

Physical guides using the face of the blade being sharpened as the reference to set the angle of the blade facets to the abrasive can be extremely precise because of the generally large and flat structure of the face of most knives. However, because the blade face must be held in relatively firm contact with the flat planar surface it is necessary to keep that surface clean of foreign materials such as swarf and abrasive fragments in order to avoid some scratching or burnishing the blade face. Because blade faces are commonly polished at the factory in a direction perpendicular to the edge, even mild abrasive action parallel to the edge can in time cause a mild burnishing along the blade face. This is not a functional problem that interferes with obtaining a sharp edge, but it is a cosmetic issue for knife collectors who purchase expensive knives. It is therefore desirable to seek improved means to eliminate this effect.

Means of reducing this scratching and burnishing effect have been described previously and patented by this inventor. These include the use of multiple rollers as disclosed in U.S. Pat. Nos. 5,406,679 and 5,449,315, guiding against vertical guide surfaces with or without rollers in U.S. Pat. Nos. 5,390,431 and 5,582,535; plastic surfaced rollers in U.S. Pat. Nos. 5,449,315 and 5,404,679; guide planes created by a number of ball bearings and moving a guided sharpener along the blade edge U.S. Pat. No. 5,582,535.

While most of the previously disclosed means of reducing random scratching or burnishing of the face of knives as they are moved along physical guides have proven useful they have not completely eliminated the scratching and burnishing. As a result research was initiated to develop improved approaches and alternative solutions that will virtually eliminate these undesirable effects for extended periods of time.

SUMMARY OF INVENTION

This invention relates to several new advanced and improved means of guiding blades, as the blade edge is sharpened by abrasive means, steeled, or conditioned, that completely eliminate scratching and burnishing or reduce the degree of scratching/burnishing to a negligible level.

These advanced and novel means disclosed here of protecting the face or other surface of a blade as it is moved slidingly in contact with a planar or other guiding or aligning structure in order to precisely align the knife edge with the sharpening, steeling or conditioning means, include advanced roller based means, light beam guides, patterned surfaces and specialized fibrous and foam contact materials on knife-guiding surfaces that offer a soft surface and have the ability to harbor and conceal foreign hardened particles that could otherwise result in scratching or burnishing on the blade face or other contacting surface of the blade.

THE DRAWINGS

DETAILED DESCRIPTION

Rolling Cylindrical Guides

This inventor has shown that knife guides comprising an array of rollers whose circumferential surfaces lie in a planar alignment can serve as guide planes for the face of a blade being sharpened. This concept was disclosed and patented by this inventor in U.S. Pat. Nos. 5,404,679; 5,390,431 and 5,582,535 and 5,449,315. As disclosed previously the rollers can be made of any of a variety of materials such as plastic or metal and the rollers can be covered with plastic or plastic sleeves. Recent developments by this inventor have shown that modified arrangements and optimized surface coverings for roller-type configurations can virtually eliminate the scratching problem.

Rollers depending on their surface materials and surface roughness can be caused to rotate because of the frictional drag of the manually held knife against the roller surfaces as the knife is moved along the plane created by the roller surfaces. Alternatively, the rollers can be motor driven at an appropriately low surface speed selected to remove or reduce the relative motion between the surface of the rollers and the surface of the hand held blade. Small separations between the revolving rollers can be maintained in order to allow most loose debris on the rollers to drop below the guiding rollers. The recent developments have demonstrated that if brush-like materials, wipers or fabrics are placed in light contact with the moving roller surfaces at circumferential locations not on the guide plane, it is possible to continuously remove abrasive and other materials from the roller surfaces as they turn. By these means the rollers remain clean and do not scratch the blades.

Figure 1:
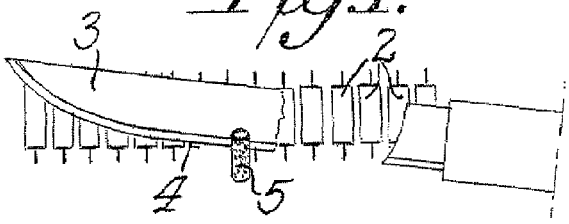
FIG. 1 shows a roller guide with an abrasive element and a knife, in accordance with this invention.

FIG. 1 shows a linear aligned array of cylindrical rollers 2, each supported by low friction axial bearings where the roller surfaces align to create a guide plane on which one face of blade 3 is moved slidingly with the facet of the blade against an edge modifying element which could be an abrasive or a steeling or a conditioning member. For purposes of illustration the element is shown as an abrasive element 5. The angular relationship of the blade and abrasive element 5 is such that the blade edge facet 4 is set in accurate alignment with the contacting plane of the abrasive element 5 to hone that facet at the desired angle. If the surface of the rollers is polished metal, their surfaces will remain relatively free of hardened debris created by the sharpening process or fragmented from the abrasive element. Some of the debris will tend to drop off the surface of the rollers as particles contact the blade without scratching the blade surface. However, as a modification of smooth uniformly surfaced rollers, the surface of the cylindrical roller can be patterned to include raised surfaces, for example to include a raised thread that will support the knife face and allow debris to fall between turns of the thread.

Figure 2:
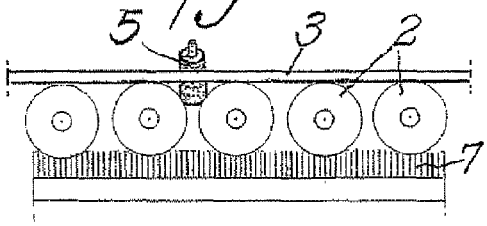
FIG. 2 shows a roller guide with a brush, in accordance with this invention.

It has been shown now as FIG. 2 illustrates that a cleaning mechanism in the form of fine bristled brushes 7 or velvet-like fabrics can be positioned in contact with the rollers to remove or reduce any remaining debris on the roller surface, the brushes being located on the back side of the rollers or at a position otherwise than on the guide plane established by the rollers 2.

Figures 3, 4, 5, 6, 7A, 7B, 8:
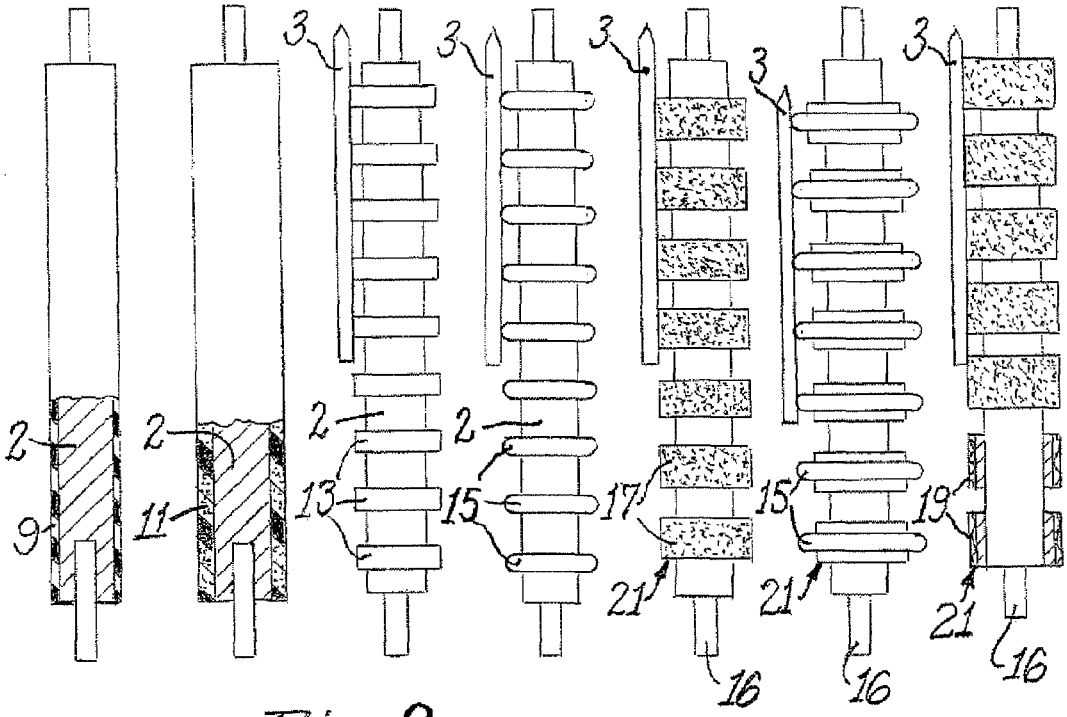
FIG. 3 shows a roller guide roller with a coating, in accordance with this invention.
FIG. 4 shows a roller guide roller with a coating, in accordance with this invention.
FIG. 5 shows a roller guide roller with spaced rings, in accordance with this invention.
FIG. 6 shows a roller guide roller with o-rings, in accordance with this invention.
FIG. 7A shows a bearing or wheel guide with a coating, in accordance with this invention.
FIG. 7B shows a bearing or wheel guide with o-rings, in accordance with this invention.
FIG. 8 shows covered wheels and bearings used as guides, partially in cross section, in accordance with this invention.

Rubberized surfaces 9 on rollers in FIG. 3 provide added frictional drag to help rotate the rollers 2 as the knife face is moved slidingly across the roller surface. Brushes or velvet-like fabrics 7 can be placed in contact with the back side of such higher friction rollers as mentioned above and shown in FIG. 2 to remove debris. FIG. 3 illustrates a roller 2 partially in cross-section with a covering or coating of rubber or other elastomeric like material.

More dramatic is the improvement that can be realized if rollers are covered with specialized fabrics, soft-touch plastic films or a foam layer (FIG. 4) or sleeve to provide softer surfaces which can remain kind to and not scratch the blade surfaces even if some small debris becomes embedded in the fabric 11. The choice and structure of optimal protective fabric materials for rollers and static guides is discussed in a following section. The roller 2 in FIG. 4, shown partially in cross-section, has a covering of such specialized fabric or foam 11 soft enough to protect the blade surface by harboring debris below the average contacting surface of such materials.

Any of the specialized covering materials for cylinders can be applied as a layer over the entire roller surface 2 or be applied in raised spaced bands or rings 13 around the cylinders as in FIG. 5.

A particular effective and novel approach to provide an improved surface for rollers is an array of rollers 2 sized to accept spaced o-rings 15 of FIG. 6 that because of their shape and spacing make only limited area or line contacts with the face of the blades. This is a very practical and favored construction because of the ready availability of o-rings in a variety of sizes and materials and it works quite well in preventing scratching of the blade face. The spacing of the o-rings must be small enough to provide sturdy support for the smallest blades to be sharpened. Variations of this are shown in FIGS. 7A, 7B and 8. FIG. 7A shows a static shaft 16 on which is mounted a series of rubber coated 17 free rotating bearings 21 spaced slightly to allow any debris to fall between the individual rubber coated bearings. FIG. 7B illustrates a static shaft 16 on which is mounted a series of free rotating bearings 21 on each of which there is at least one o-ring 15. FIG. 8 shows another variation of a shaft 16 with spaced bearings 21 each covered with a fabric, foam, or soft-touch material 19. An array made of multiple units of the rotating shafts as shown in FIGS. 5, 6, 7A, 7B, and 8 can be mounted to create an effective planar guide for the face of a knife that does minimize scratching of the blade surface.

Steel rollers with spaced banded rings of materials or o-rings as described above can be magnetized to attract and hold metal debris that is carried onto the rolling structures by the face of the contacting blade. The magnetic field so established in the steel roller can attract and hold swarf left on the blade. Alternatively magnets can be mounted adjacent to steel rollers or bearings to attract any loose ferromagnetic debris and remove it from the roller surfaces.

Ball Bearings as Knife Guides

Figure 9:
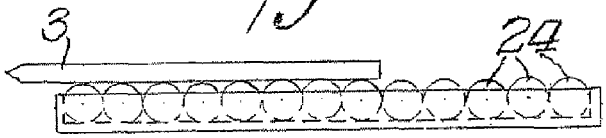
FIG. 9 shows a ball bearing guide in elevation view, in accordance with this invention.

Arrays of ball bearings, such as disclosed in U.S. Pat. No. 5,582,535 (all of the details of which are incorporated herein by reference thereto), likewise lying in a plane can be used to create a planar guide surface for a blade face. Because ball bearings must be retained they are commonly captured in linear or circular arrays. For planar knife guides linear arrays of at least three small bearings such as sold by National Bearings, can be arranged either running lengthwise or transverse to the long axis of a planar knife guide. Smaller ball bearings 24 are to be preferred as the distance between their centers provides a "smoother" surface—of particular advantage with very small blades. The balls 24 extend from the open face of a housing which maintains the balls in contact with each other. A preferred geometry is a plane constructed of at least three transverse arrays shown in FIG. 9. The advantage of this type of array is the fact that there are only points of contacts between the bearings and the face of the blade producing a structure that reduces greatly the opportunity to scratch or burnish the face of the blade. Debris tends to collect either between the individual balls in the individual arrays or fall between and below the separate balls and the separate arrays as they are spaced along the guide plane.

The balls can be free spinning or they can be fixed, however it is preferable that they be free rotating with minimum friction.

Patterned Static Surface Guides

Figure 10:
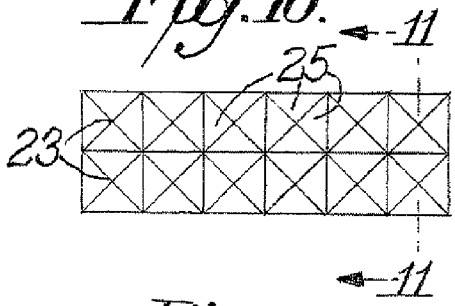
FIG. 10 shows a molded pattern on a knife guide, in accordance with this invention.
Figure 11:
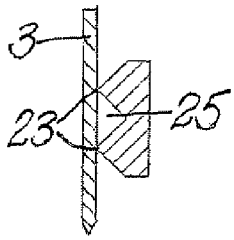
FIG. 11 shows a cross section of a molded pattern, in accordance with this invention.

Patterned surfaces created by machining, casting, or molding the surface of planar guides can simulate the line contacts of rollers or the point contacts of ball bearings and can be used as guiding surfaces to reduce scratching of the blade face. These are readily created by the precise modern plastic molding techniques. FIGS. 10 and 11 show plan and cross-sectional view of an illustrative pattern which form a planar guide surface that is patterned to reduce the area or points 23 of contact with the blade. Recesses 25 are provided adjacent the points or lines or regions of contact to collect debris and reduce contact of the debris with the face of the blade, 3. An even simpler pattern would be rows of short vertical cylinders or spherical dots molded onto plastic rubber or foam-like materials that constitute the guiding surface. Patterned guide surfaces of this sort can be created for example using plastics, metal, rubber, or leather-like materials. Such patterns can be helpful on guide surfaces of any shape including flat planar surfaces or cylinders.

Specialized Surfaces, Fibers and Coverings for Knife Guide Surfaces

Figure 12:
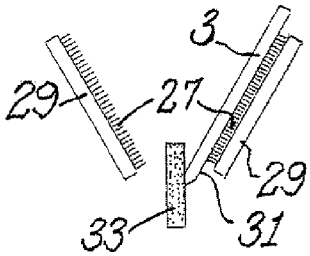
FIG. 12 shows an inclined guide with vertical fibers on surface, in accordance with this invention.

This inventor has found that one of the most effective of the novel guides described herein are arrays of vertical fibers 27 as shown in FIG. 12. These can be molded directly, one end into the surface of a plastic plate guide by an insert molding process, they can be applied as a flocked spray, or applied or woven into a secondary film, fabric, or backing easily applied to the guide surface 29 with adhesive or a pressure sensitive adhesive. FIG. 12 illustrates how such arrays of vertical fibers 27 can protect the face 31 of blade 3 as the blade is moved along in sliding contact with them. The knife edge is shown contacting an abrasive element 33.

An ideal non-scratch surface is a bed of flexible closely packed vertical fibers about 0.025 to 0.1" long. This provides a bed sufficiently deep to harbor typical small hardened debris such as swarf (metal particles) and abrasive particles commonly generated in a knife sharpening environment. The diameter of the individual fibers commonly less than 0.001 inch is not highly critical, but they should be flexible yet have sufficient stiffness and be sufficiently dense (fibers per unit of area) to resist serious bending under pressure of the knife blade as it is pulled across the guide. The fibers should not be so dense or stiff that the debris when contacted by the blade cannot easily settle below the surface of the fibers without scratching the blade. The fiber length should be at least 5 times the size of the debris, but preferably more than 10 times. The inherent pliability or yieldability spring-like nature of flexible vertical fibers prevents random debris from exerting excessively high forces against the contacting surface of the blade whenever such particulate debris becomes momentarily positioned between the fibers and the blade. In this manner the debris can move below the surface of fiber bed, where it can be concealed from the surface of the blade, and consequently will not deface the contacting blade surface.

As an example, we found the dimension of sharpening debris to be less than 3 thousandths of an inch when using diamond abrasives in the range of 100-300 grit, in a motor driven sharpener. Velvet-like fabrics with fiber lengths of 0.060 inch worked exceedingly well against the knife face. No scratching or burnishing was observed after several thousand strokes of the knife face while sharpening. Much shorter fibers also worked very well.

Flocks, felts and foams also work well as protective coverings for knife guides. Flocks and felts of randomly oriented lightly bonded fibers have however been found to be not as protective, over longer periods of time as a velvet-like bed of vertical fibers.

Figure 13:
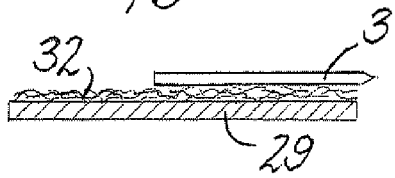
FIG. 13 shows a rigid guide with flocked material coating, in accordance with this invention.

Because flocks and felts 32 on guide surface 29, as in FIG. 13, have a matt-like structure, they must in general be applied as a deeper layer to provide coverage and cushioning of the hardened sharpening debris.

Foam layers can be effective if they are relatively soft and preferably open-pored to provide spaces for collection of debris. These can be sprayed onto planar guide planes or applied as sheet material with adhesive backing. They can also be insert-molded onto the surface of molded plastic guides.

Vertical fibers whether insert-molded or attached to fabric backings as they are in cut velvets work well. The backings can be coated with pressure sensitive adhesive for easy attachment and removal from the knife guides. Vertical fibers as the term is used here is an array of individual tightly packed fibers oriented nominally perpendicular to a supporting substrate such as plastic or a fabric structure. Cut velvet fabrics are typical of an ideal vertical fiber structure. Loop velvet fabrics also are effective.

Figure 14:
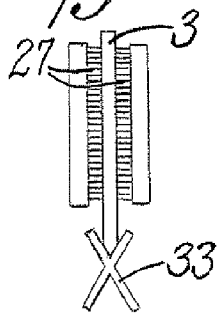
FIG. 14 shows vertical fiber guides on both side of a blade, in accordance with this invention.
Figure 15:
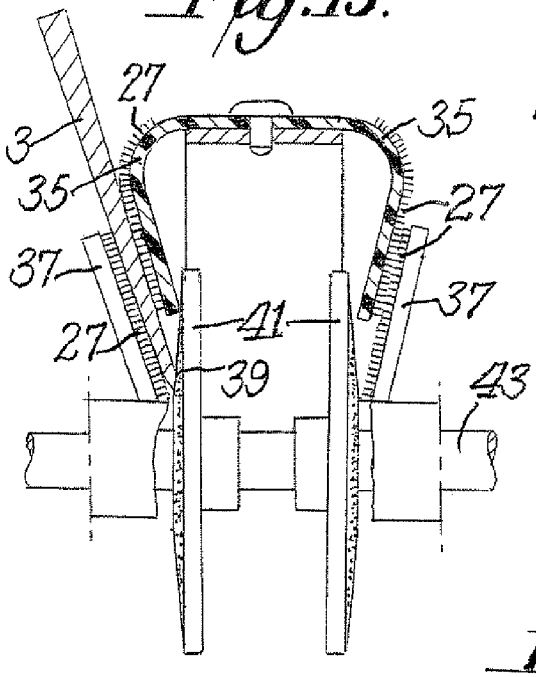
FIG. 15 shows vertical fibers on an inclined plane guide and on a knife retaining spring, in accordance with this invention.

Fibers in the form of brushes or as vertical fibers extending from fabric backings can be used also to effectively define a slot as shown in FIG. 14 for simultaneous guidance of both faces of a blade placed in that slot. It is particularly convenient to use fibers to form the slot as shown in FIG. 14 to press simultaneously on both sides of the blade if the blade is oriented vertically as shown. These work well also in powered sharpening configurations that have inclined planar guides for a blade face and plastic springs that press against the opposite blade face to steady the blade as shown in FIG. 15. Plastic springs 35 of FIG. 15 often are used in such sharpening stages to press the blade face gently against inclined guides 37 as one face of the blade 3 is pulled manually along the guide with its edge 39 in contact with a powered or fixed abrasive element 41. Vertical fiber structures 27 on surfaces of both the inclined guides 37 and the face of the knife holding spring 35 works very well since both sides of the blade can then be cleaned of debris simultaneously on each sharpening stroke. Experience has shown that such knife holding springs without protection of this sort can occasionally scratch and burnish the faces of the blade. Vertical fiber structures can be used similarly on any other surface that a face or structural member of the blade might contact. In FIG. 15 abrasive element wheels 41 are motor driven by shaft 43. However, non-powered sharpeners with positioned abrasives can employ these same types of fiber structure to protect effectively the blade faces from scratching and burnishing.

Fiber structures can, as mentioned, be insert molded onto the face of a blade guiding surface, or be supported by fabrics permanently bonded or attached to a blade guiding surface. It is particularly convenient to provide such fiber structures with a woven or flexible backing that can be coated with a pressure sensitive adhesive for easy manual application to and removed from knife guiding surfaces.

Fabric structures attached to knife guides by pressure sensitive adhesive have the great advantage that if they become soiled by foreign materials such as food, oils, etc. they can be readily replaced. Likewise after long periods of use attached to the knife guide, if they become significantly loaded with sharpening debris it is a simple matter to replace them.

Figure 15A:
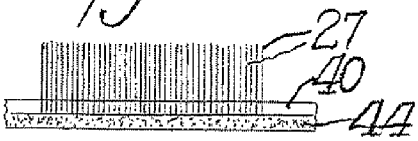
FIG. 15A shows vertical fibers on a backing material, in accordance with this invention.

FIG. 15A is a cross-section of a readily attachable structure of vertical fibers 27 shown attached to a backing material 40 such as a fabric-like structure, a flexible film-like material or an ore rigid support which is in turn coated with a pressure sensitive adhesive 44. Similar structures can be fabricated with felts, foams, non-woven fibers, or a soft suede-like upper layer instead of the vertical fibers. These can be readily mounted on a guide substructure and replaced as necessary.

A characteristic of the previously described embodiments is that a surfaced knife guiding structure is provided that minimizes scratching, abrading, burnishing or defacement of the knife blade as it makes sustained moving contact with the guide surface of the structure. The guide surface is nonabrasive and has a configuration to allow particles of swarf and abrasive material resulting from the edge modifying process to move below the guide surface if contacted by the moving blade. Such configuration could be the spacing between the contact regions of the rollers or balls or could result from the flexible fibers or could result from the materials on the guide surface.

Optical Means for Guiding Blades

Optical and electro optical means have been developed by this inventor to provide angle control for blades during sharpening which eliminates entirely the need for physical contact between a guide and the face of the blade being sharpened.

Figure 16:
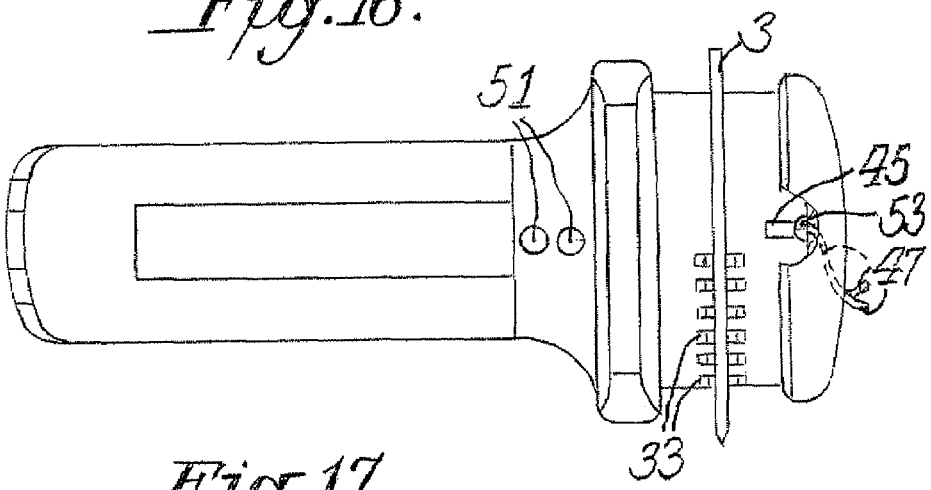
FIG. 16 shows a knife sharpener with an optical knife guide in plan view, in accordance with this invention.
Figure 17:
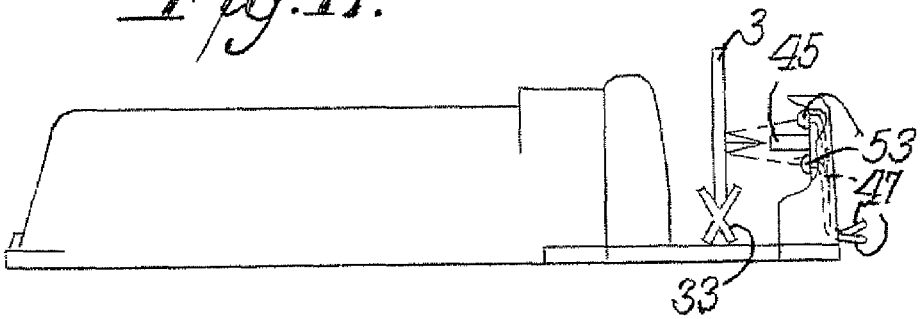
FIG. 17 shows a knife sharpener with an optical knife guide in elevation view, in accordance with this invention.
Figure 16A:
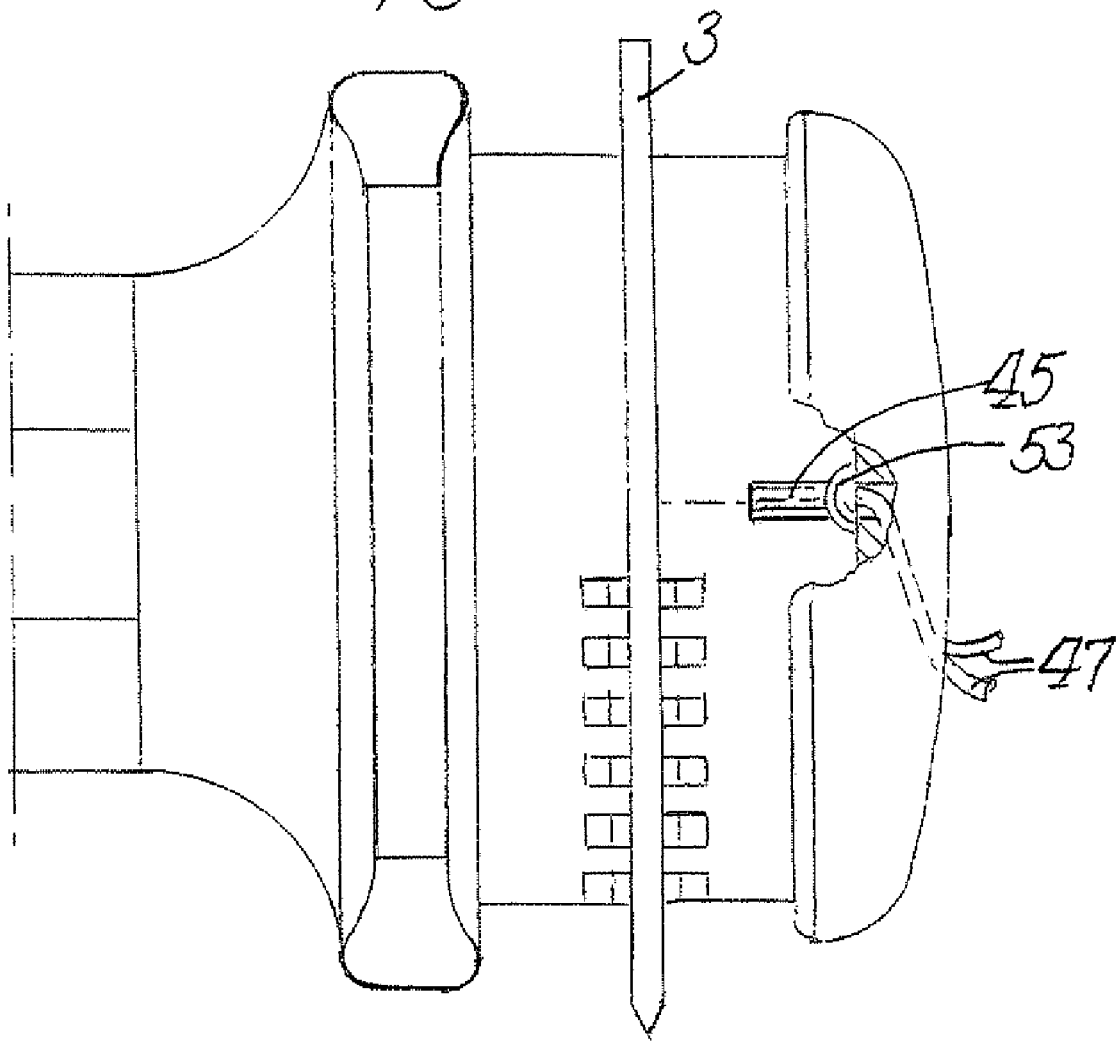
FIG. 16A shows an enlarged view of a portion of FIG. 16.

In the simplest concept light from a light emitting diode or other type of light source 45 reflects off of one side of the blade as shown in FIGS. 16, 16A and 17. Reflected light emitted from the diode and reflected off the blade surface is captured, for example by a pair of concentrating lenses 53 and two fiber optic bundles 47, shown in FIGS. 16, 16A and 17 and transmitted to an indicator 51 at a prominent location on the sharpener that can be easily observed by the user with the help of light dispersing lenses. The angular position of the knife must be maintained precisely by the user in order that the relative intensity of the two beams reflected from the blade as seen at indicator 51 by the user is matched while the knife is being sharpened. By matching the light intensity reflected onto each fiber ends the angle of the blade facets (adjacent the knife edge) relative to the abrasive elements 33 remains relatively constant.

Figure 18:
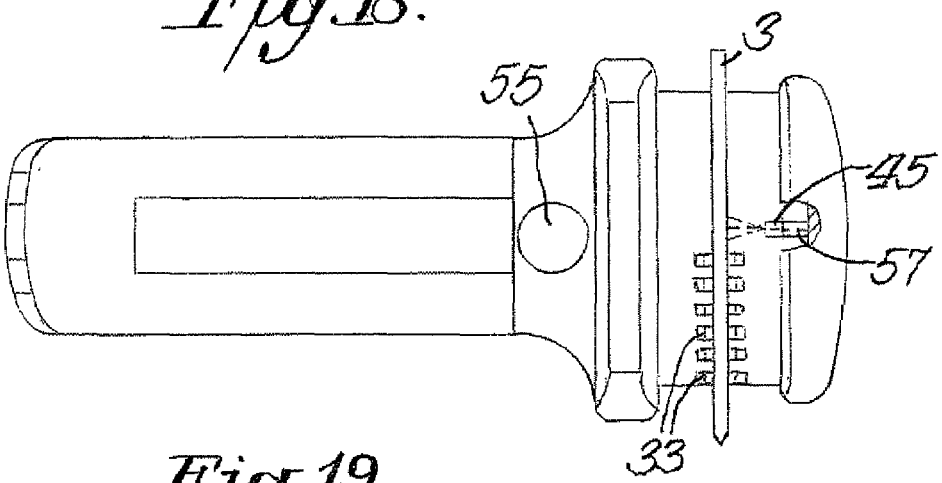
FIG. 18 shows a knife sharpener with an electro optical knife guide in plan view, in accordance with this invention.
Figure 19:
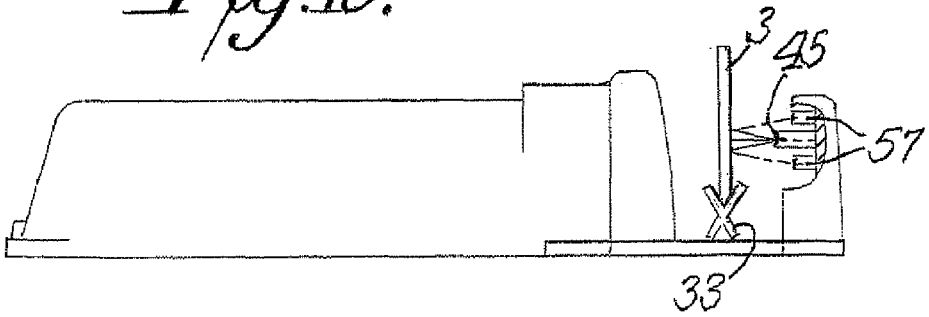
FIG. 19 shows a knife sharpener with an electro optical knife guide in elevation view, in accordance with this invention.

Alternatively as shown in FIGS. 18 and 19 the light from a light emitting diode (LED) 45 reflected off one side of the blade can be captured by two light sensitive detectors 57 and compared electronically. A visual or audio signal can be generated or displayed at the position of indicator 55 that assists the user to angularly align the blade vertically. The intensity of the indicating light or sound at indicator 55 can be maximized when the intensity of the reflected beams is balanced.

Figure 20:
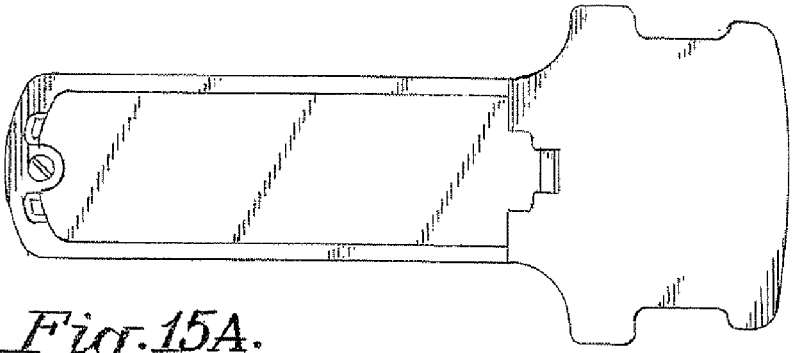
FIG. 20 shows a bottom plan view of the knife sharpener of FIGS. 16 to 19 identifying the lower compartment.

The abrasive element 33 of FIGS. 16 thru 19 can be a stationary array of abrasive elements, such as interdigitating abrasive elements. The same knife guiding means could be employed with a series of powered abrasive wheels. In the illustrative configurations of FIGS. 16 thru 19, there is an underside compartment 59 (FIG. 20) for storage of a battery and for mounting of electronic circuitry for the LED, light sensitive detectors, and the visual or audio signaling means.

What is claimed:

1. A knife sharpener for modifying the edge of a knife blade by abrasive sharpening, steeling or conditioning the blade edge, comprising at least one edge modifying element, at least one knife guide to control the angle of the blade and its edge facet relative to said at least one edge modifying element, said guide comprising a light source for directing at least one light beam that impinges on at least one surface of the blade, at least one optical element to receive light reflected from said blade and to display the intensity of that light at a position on the sharpener that can be directly viewed by the user to assist the user maintain a constant angle of the blade as it is moved through said sharpener with its edge in contact with at least one edge modifying element.

2. A knife sharpener according to claim 1 wherein said edge modifying element is located on said sharpener between said light source and said indicator.

3. A knife sharpener according to claim 1 wherein the optical element comprises a pair of lenses and fiber optic bundles whereby the intensity of light reflected by the blade to each member of the pair is displayed for direct view by the user.

4. A knife sharpener according to claim 3 where the displayed intensity of light received by each member of the pair can be readily compared or matched to indicate when the blade is in constant angular position.

5. A knife sharpener for modifying the edge of a knife by abrasive sharpening, steeling or conditioning the blade edge, comprising at least one edge modifying element, at least one electro-optical knife guide to control the angle of the blade and its facet relative to said at least one edge modifying element said guide comprising a light source for directing at least one light beam that impinges on at least one surface of the blade, at least one light sensitive detector that generates an electrical signal of magnitude related to the intensity of light reflected from the blade and impinging on said detector where said signal is visually displayed for or heard by the user to assist in maintaining a constant angle of the blade as it is moved through said sharpener with its edge in contact with at least one edge modifying element.

6. A knife sharpener according to claim 5 where the electro-optical guide comprises a pair of light sensitive detectors that monitor the intensity of light reflected from the blade and generate individual electrical signals that are presented individually or comparatively by sound or light indicators accessible to the user to assist in maintaining a constant angle of the blade.

* * * * *